United States Patent [19]

Singarayar et al.

[11] Patent Number: 4,905,132

[45] Date of Patent: Feb. 27, 1990

[54] LAMP FIXTURE WITH A MODIFIED ENCLOSURE PLATE

[75] Inventors: Santiago Singarayar, Burlington; Robert M. Parker, Greensboro, both of N.C.

[73] Assignee: Regent Lighting Corporation, Burlington, N.C.

[21] Appl. No.: 289,364

[22] Filed: Dec. 22, 1988

[51] Int. Cl.[4] ..... F21V 29/00

[52] U.S. Cl. ..... 362/294; 362/345; 362/373; 362/414; 362/431

[58] Field of Search ..... 362/370, 294, 344, 345, 362/373, 409, 414, 431, 456, 368

[56] References Cited

U.S. PATENT DOCUMENTS 3,573,452 4/1971 Kenyon et al. ..... 362/294
3,784,808 1/1974 Mori ..... 362/294
4,319,313 3/1982 Eberhart et al. ..... 362/370
4,595,971 6/1986 Dean ..... 362/345

*Primary Examiner*—Ira S. Lazarus
*Assistant Examiner*—Sue Hagarman
*Attorney, Agent, or Firm*—Lynn E. Barber

[57] ABSTRACT

A light fixture having a flanged upper housing, a support arm on the housing, and a reflector below the upper housing designed to dissipate heat. The reflector has an upper planar surface that fits within the flange of the upper housing. The upper planar surface has a peripheral opening extending from the edge of the upper planar surface toward the center of the upper planar surface at the side of the upper planar surface that is adjacent the support arm. An enclosure box may be placed over the peripheral opening and attached to an enclosure plate that is located at the opening of the support arm into the housing.

13 Claims, 7 Drawing Sheets

LAMP FIXTURE WITH A MODIFIED ENCLOSURE PLATE

BACKGROUND OF THE INVENTION

1. Field of the Invention

This invention relates to light fixtures, and more particularly, to a light fixture that may be used out-of-doors and has a reflector that allows the fixture to vent through a support arm.

2. Description of the Related Art

Light fixtures that are used out-of-doors (luminaires) must be designed to dissipate heat that builds up within the fixture. Specially designed reflectors or reflector assemblies are often used to dissipate the heat. For example, the reflector of Dean (U.S. Pat. No. 4,595,971) is affixed to the upper housing of the luminaire, and is bowl-shaped and has a plurality of openings or slotted holes in the reflector upper surface near, but not at, the edge junction between the upper surface and the downwardly curving edges of the reflector. The means of positioning the upper surface of the reflector, with the slotted holes under a rim or flange on the upper house, shields the lamp from precipitation and keeps the light ballast sealed from the atmosphere to meet the Underwriters' Laboratories requirements. This patent is incorporated herein by reference.

The luminaires also have support arms extending outwardly from the upper housing. The openings in the Dean fixture are located only in the area under the flange and are not present in the area where the support arm opens to the upper housing. An enclosure plate may be placed in the opening between the housing and the support arm for further protection of the electrical elements in the upper housing. The enclosure plate also serves to keep birds or the customer's hands from coming into contact with the electrical components. An enclosure plate used by F.L. Industries (Livingston, N.J.) comprises a steel or aluminum piece that fits within this opening and has angled sides bent to fit on the edge of the opening.

It is an object of this invention to provide a light fixture having improved heat dissipation characteristics, while providing appropriate isolation of the electrical components.

Other objects and advantages will be more fully apparent from the following disclosure and appended claims.

SUMMARY OF THE INVENTION

The light fixture of the invention comprises:

(a) an upper housing and an outwardly extending support arm, said support arm having an opening into one side of the upper housing; and (b) a reflector attachable to said upper housing, said reflector having an upper planar surface, said upper planar surface having a peripheral opening located on the side of the planar surface where the support arm is located, wherein the primary path of heat escape from the light fixture is through the peripheral opening and the support arm.

In a first embodiment, the invention is a light fixture comprising:

(a) an upper housing having a central lamp socket, and an outwardly extending support arm, said support arm having an opening to one side of the upper housing;

(b) a reflector attachable to said upper housing, said reflector having an upper planar surface, said upper planar surface having a centrally located opening and a peripheral opening, said peripheral opening having a first side located at the edge of said planar surface at the side of the housing having the support arm and a second side opposite the peripheral opening from said first side and located on the planar surface between the centrally located opening and the first side; and (c) an enclosure plate located in the opening between said support arm and said housing, said enclosure plate displaced inwardly within said upper housing from the edge of said planar surface, said enclosure plate being essentially perpendicular to and above the second side of said peripheral opening.

The invention may also comprise a downwardly extending housing flange as found in prior light fixtures with the planar surface fitting within the flange.

In a second embodiment, the peripheral opening extends from the edge of the upper planar surface, adjacent to the enclosure plate, toward the centrally located opening with the second side very near the centrally located opening. Preferably in this embodiment, an enclosure box is attached to the enclosure plate and extends from the enclosure plate within the upper housing toward the central lamp socket to increase the heat dissipation. In this embodiment the enclosure plate is above a central portion of the peripheral opening and the enclosure box is above the areas of the peripheral opening between the center of the upper planar surface and the enclosure plate. The enclosure plate and the enclosure box are preferably made of steel or aluminum or other heat-tolerant substance. The enclosure plate and the enclosure box are preferably made in one piece.

Other aspects and features of the invention will be more fully apparent from the following disclosure and appended claims.

DETAILED DESCRIPTION OF THE INVENTION AND PREFERRED EMBODIMENTS THEREOF

The present invention comprises a light fixture having an upper housing and a reflector. In particular, the reflector of the invention has an improved heat dissipation structure with a large peripheral opening in the upper surface of the reflector over the portion of the support arm of the light fixture adjacent the housing. Thus, the primary path of heat escape from the light fixture is through the peripheral opening and out the support arm. In another embodiment, there is also an enclosure box over the large peripheral opening.

Figure 1:
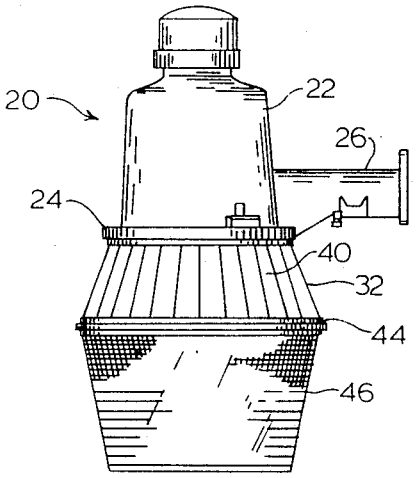
FIG. 1 is a side view of a light fixture.
Figure 2:
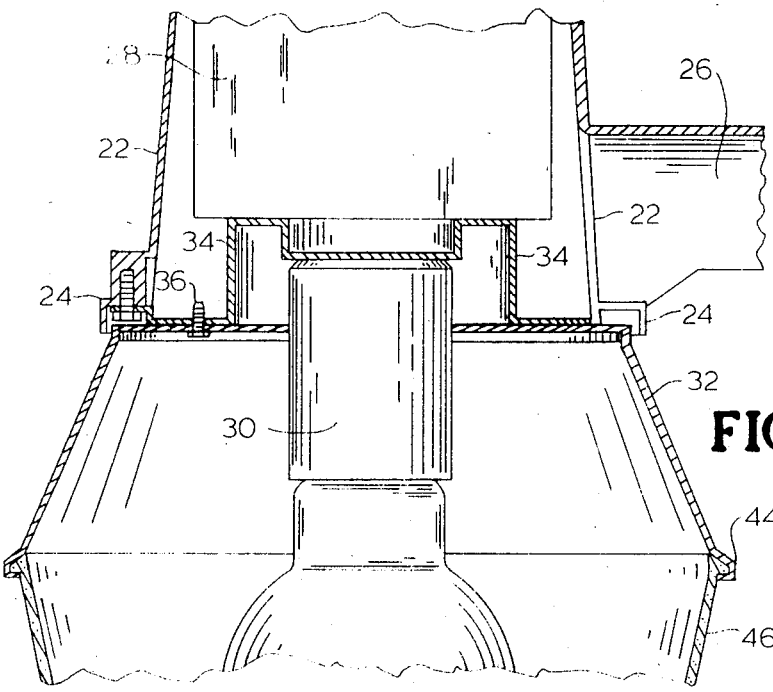
FIG. 2 is a partial cross sectional view of a light fixture.
Figure 3:
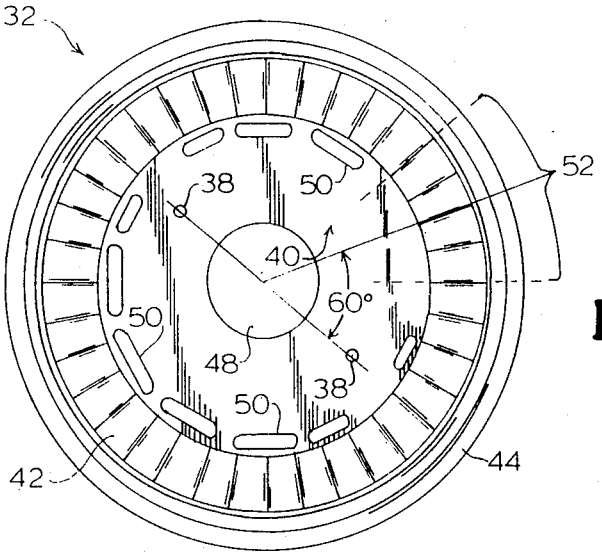
FIG. 3 PRIOR ART
FIG. 3 is a top view of a reflector of the prior art.

The general structure of a light fixture according to the invention has similar external features to those of prior outdoor light fixtures. As shown in FIG. 1, a typical outdoor light fixture 20 is comprised of a housing 22 having a downwardly extending flange 24. This flange 24 is not necessary in the light fixture of the invention. A support arm 26 extends outwardly from one side of the housing 22. The electrical components 28 are located within the housing 22 above a lamp socket 30 that is mounted in the center of the housing 22 and extends downward (FIG. 2). A reflector 32 generally made of aluminum is attached to brackets 34 on the housing by means of screws 36 that extend through holes 38 on an upper planar surface 40 of the reflector 32 (FIG. 3). The reflector 32 has sloping sides 42 that extend downward and outward from the upper planar surface 40. A lower rim flange 44 on the reflector allows a refractor 46, generally made of glass or plastic, to be held below the reflector 32 as discussed in U.S. Pat. No. 4,595,971.

Figure 4:
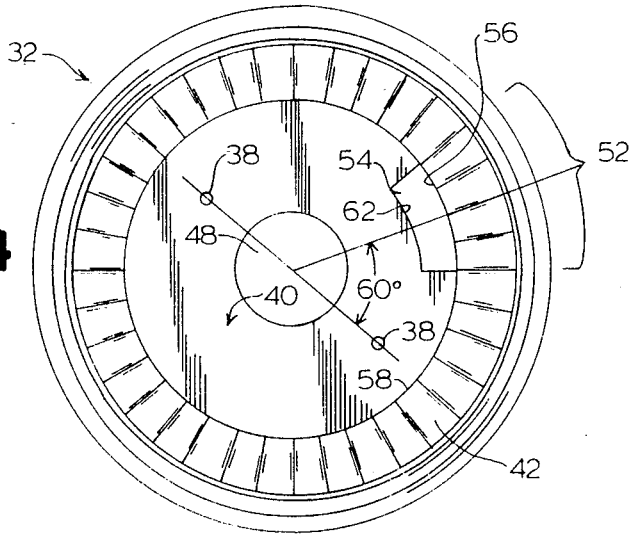
FIG. 4 is a top view of a first embodiment of the reflector of the invention.

The prior reflector of U.S. Pat. No. 4,595,971 is shown in FIG. 3. There is a centrally located opening 48 in the upper planar surface 40 for the lamp socket to fit through. This prior reflector 32 also includes a plurality of elongated slots 50, vents or openings positioned around much of the upper planar surface 40 of the reflector 32 and located under the flange 24 of the housing 22 when the reflector is attached to the housing 22. In this prior reflector, there is no housing flange 24 in the area of the support arm and there are also no slots in this arm area 52 of the upper planar surface 40. The support arm area 52 is centered about a line extending at an angle of 60° from a line connecting the holes 38 as shown in FIGS. 3 and 4.

Figure 5:
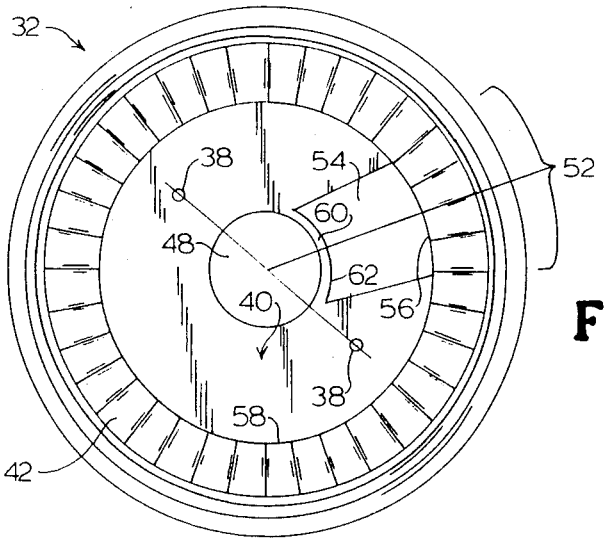
FIG. 5 is a top view of a second embodiment of the reflector of the invention.

In the preferred embodiment, the reflector 32 of the invention (FIGS. 4 and 5) does not have the plurality of elongated slots 50 around the upper planar surface 40, but rather has one large peripheral opening 54 in the arm area 52 of the upper planar surface 40. The peripheral opening 54 is centered in the arm area 52 of the upper planar surface 40. This peripheral opening 54 has a first side 56 along the outermost edge 58 of the planar surface 40. The peripheral opening 54 extends from the outermost edge 58 of the upper planar surface 40 toward the centrally located opening 48. For example, in a reflector upper surface having an approximate diameter of 6½ inches, the peripheral opening 54 may be as narrow as about ½-inch as in the first embodiment (FIG. 4) or may extend for about 1⅞ inches centrally all the way to the centrally located opening 48 with only a narrow band 60 separating the centrally located opening 48 from a second side 62 (opposite the first side) of the large peripheral opening 54 as in the second embodiment (FIG. 5). Although the presence of elongated slots 50 is not necessary in the invention, such slots may be present in addition to the peripheral opening 54.

Figure 6:
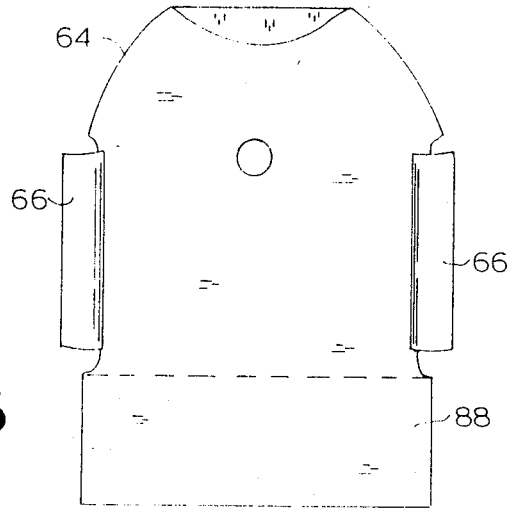
FIG. 6 PRIOR ART
FIG. 6 is an external perspective view of a prior enclosure panel.

Enclosure panels 64 (FIG. 6) as are provided in certain prior outdoor light fixtures are about 2¼ inches long and about 1¾ inches wide in a typical luminaire so that an enclosure panel fits in the opening at the end of the support arm toward the housing being placed perpendicular to the upper planar surface of the reflector. Curved areas 66 on the enclosure panels 64 enable the enclosure panel 64 to be placed at the proximal end of the support arm 26 by slipping the curved areas 66 over posts 68 on the housing 22 at the opening of the upper housing 22 to the support arm 26 (FIG. 9).

Figure 12:
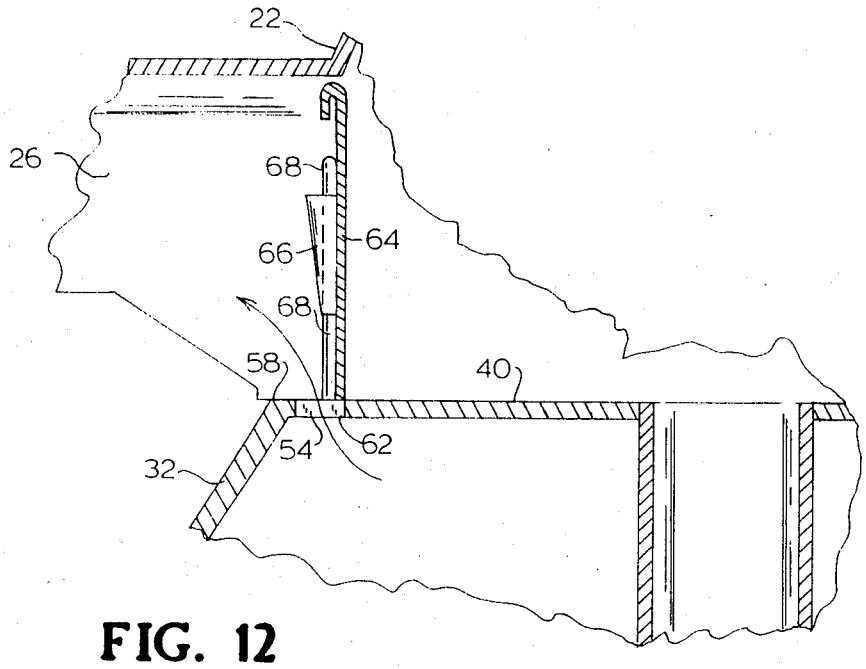
FIG. 12 is a partial crossection of the peripheral opening and enclosure panel of the first embodiment of the reflector.

As seen in FIG. 12, the location of the enclosure panel 64 according to the first embodiment of the invention is inset from the edge 58 of the upper planar surface 40 in the area where the support arm 26 joins the housing 22 along the second side 62 of the peripheral opening 54 and perpendicular to and above the upper planar surface 40. Heated air in the reflector rises as shown by the arrow through the peripheral opening 54 and into the support arm 26.

Figure 7:
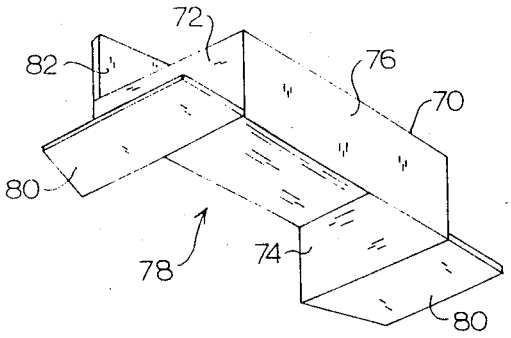
FIG. 7 is a lower back perspective view of the enclosure box of the invention.
Figure 8:
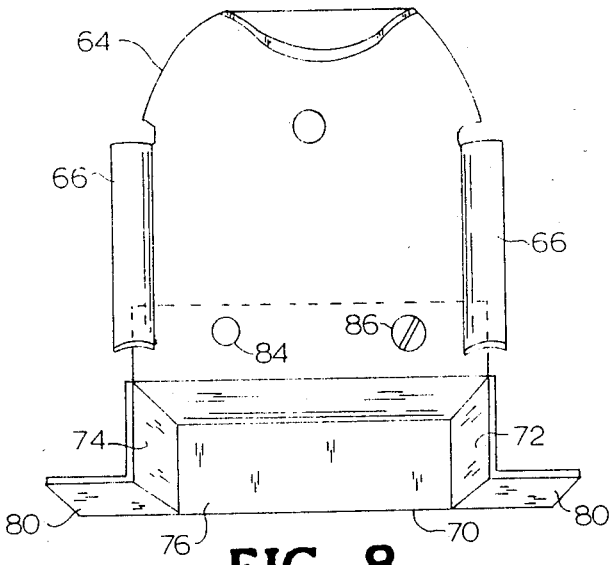
FIG. 8 is a front side perspective view of the enclosure box of the invention attached to a modified enclosure panel.

To protect the light fixture of the invention more fully from rain and to increase heat escape from the light fixture, an enclosure box 70 is placed over the peripheral opening 54 (FIGS. 7–9) particularly with the larger peripheral openings. The enclosure box 70 (FIG. 7) comprises a downwardly opening rectangular box having three faces (left side 72, right side 74, and backside 76) and an open side 78 at the front of the box. Although not necessary, there is an outwardly extending flap 80 on each side face so that the enclosure box 70 fits tightly to the upper planar surface 40 to provide a path below the enclosure box 70 for hot air to escape to the support arm 26 and not to the ballast compartment. An attachment tab 82 with attachment holes 84 extends above the open front face 78. When the enclosure box 70 is positioned within the housing 22 over the peripheral opening 54, the open front side 78 of the enclosure box 70 is toward the support arm 26 (FIGS. 8–9). The attachment tab 82 is attached to the enclosure panel 64 with nuts and bolts 86, said bolts extending through the attachment holes 84 and through holes (not shown) made in the enclosure panel 64. A rectangular area 88 (FIG. 6) of the enclosure panel 64 is preferably removed when the enclosure box 70 is used to allow heat to move out of the interior of the reflector through the enclosure box 70 and out the support arm 26. The alignment of the upper housing 22 including the enclosure box 70 with the reflector of the second embodiment of the invention is shown in FIGS. 9 and 11 and the assembled fixture of the invention is shown in FIG. 10.

Figure 9:
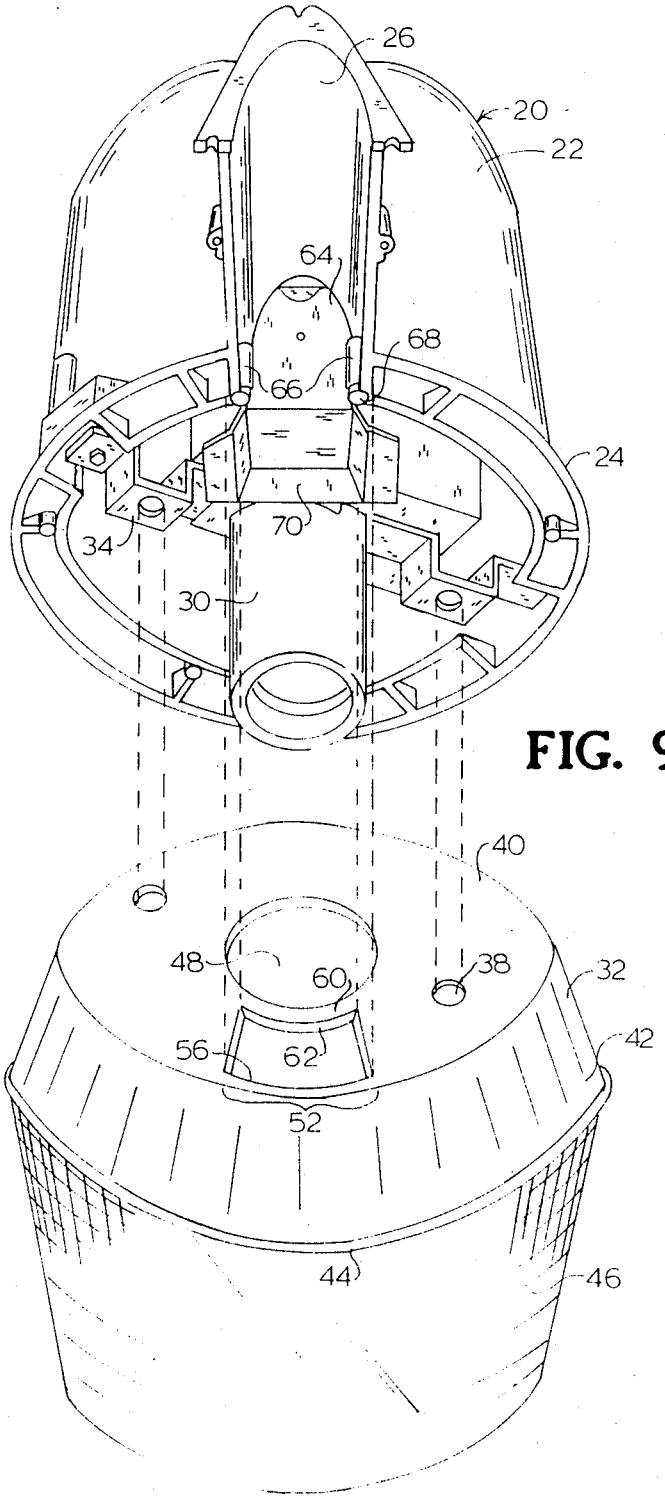
FIG. 9 is a perspective view of the housing fixture showing how the enclosure box aligns with the reflector of the second embodiment.
Figure 10:
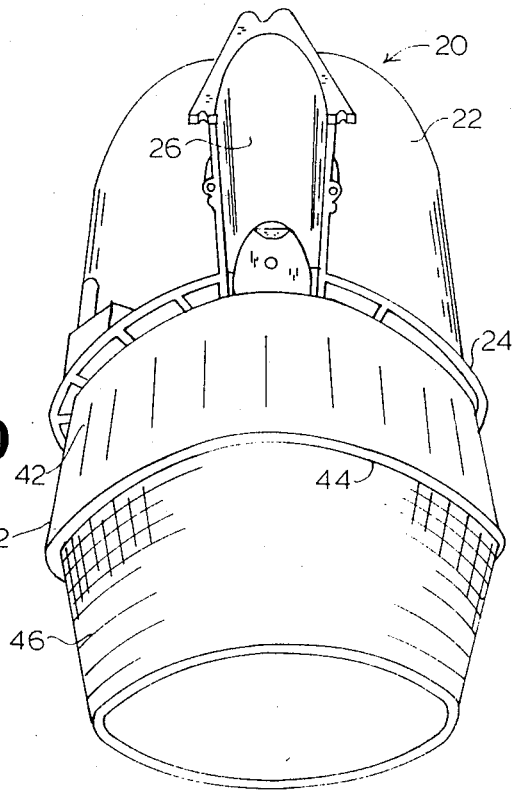
FIG. 10 is a perspective view of the assembled housing fixture of the invention showing the reflector and enclosure panel area as visible within the support arm.
Figure 11:
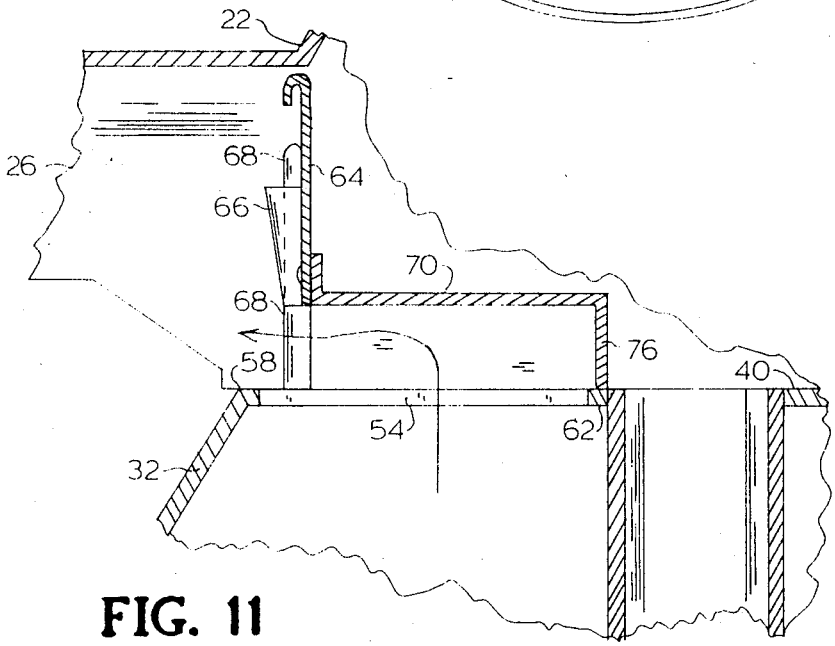
FIG. 11 is a partial crossection of the peripheral opening and enclosure panel of the second embodiment of the reflector.

The placement of an enclosure panel 64 and enclosure box 70 in a light fixture according to the second embodiment of the invention is shown in FIGS. 9 and 11. As in the first embodiment (FIG. 12), the enclosure panel 64 is inset from the edge 58 of the upper planar surface 40 in the area where the support arm 26 joins the housing 22. The enclosure panel 64 is also again perpendicular to and above the upper planar surface 40. Unlike the first embodiment, the second side 62 of the peripheral opening is not beneath the enclosure panel 64, but rather is beneath the back side of the enclosure box 70. This arrangement allows hot air from the reflector area to rise into the enclosure box through the peripheral opening 54 and out into the support arm 26 as shown by the arrow in FIG. 11.

In the second embodiment of the invention that has an enclosure box 70, the enclosure panel 64 and enclosure box 70 are preferably made in one piece as shown in FIG. 9 to increase the ease of construction and decrease costs. Although it is also possible to manufacture all or part of the enclosure plate and box in the same piece as the reflector, this may not be as cost effective as making the reflector separately.

While the invention has been described with reference to specific embodiments thereof, it will be appreciated that numerous variations, modifications, and embodiments are possible, and accordingly, all such variations, modifications, and embodiments are to be regarded as being within the spirit and scope of the invention.

What is claimed is:

1. A light fixture comprising:

(a) an upper housing and an outwardly extending support arm, said support arm having an opening into one side of the upper housing; and (b) a reflector attachable to said upper housing, said reflector having an upper planar surface, said upper planar surface having a peripheral opening, said peripheral opening located on the side of the planar surface where the support arm is located, wherein the primary path of heat escape from the light fixture is through the peripheral opening and the support arm.

2. A light fixture comprising:

(a) an upper housing having a central lamp socket and an inwardly and outwardly extending support arm, said support arm having an opening into one side of the upper housing;

(b) a reflector attachable to said upper housing, said reflector having an upper planar surface, said planar surface having a centrally located opening and a peripheral opening, said peripheral opening having a first side located at the edge of said planar surface at the side of the housing having the support arm and a second side opposite the peripheral opening from said first side and located on the planar surface between the centrally located opening and the first side, said peripheral opening being centered at the opening of the support arm; and (c) an enclosure plate located in the opening between said support arm and said upper housing, said enclosure plate displaced inwardly within the upper housing from the edge of said planar surface, said enclosure plate being essentially perpendicular to and above the second side of said peripheral opening.

3. A light fixture according to claim 2, further comprising a downwardly extending flange, said upper planar surface fitting within said flange.

4. A light fixture according to claim 2, wherein said enclosure plate substantially covers the opening between said support arm and said upper housing.

5. A light fixture according to claim 4, wherein the diameter of the upper planar surface is about six and one-half inches and the distance between the first side and the second side is about one-half inch.

6. A light fixture according to claim 2, further comprising an enclosure box attached to the enclosure plate and extending from the enclosure plate within the upper housing toward the central lamp socket.

7. A light fixture according to claim 2, wherein the peripheral opening extends across the upper planar surface toward the centrally located opening.

8. A light fixture according to claim 6, wherein the peripheral opening extends across the upper planar surface toward the centrally located opening.

9. A light fixture according to claim 8, wherein the diameter of the upper planar surface is about six and one-half inches and the distance between the first side and the second side is about two inches.

10. A light fixture according to claim 6, wherein the enclosure box and the enclosure plate are made in one piece.

11. A light fixture comprising:

(a) an upper housing having a central lamp socket and an outwardly extending support arm, said support arm having an opening into one side of the upper housing;

(b) a reflector having an upper planar surface, said planar surface having a centrally located opening and a peripheral opening, said peripheral opening extending from the edge of said planar surface across the upper planar surface toward the centrally located opening, said peripheral opening being centered at the opening of the support arm;

(c) an enclosure plate located between said support arm and said upper housing; and (d) an enclosure box attached to the enclosure plate and extending from the enclosure plate within the upper housing toward the central lamp socket.

12. A light fixture according to claim 11, wherein the enclosure box and the enclosure plate are made in one piece.

13. A light fixture according to claim 11, further comprising flaps on the sides of the enclosure box.

* * * * *